US009077107B2

(12) United States Patent
Lloyd et al.

(10) Patent No.: US 9,077,107 B2
(45) Date of Patent: Jul. 7, 2015

(54) CONNECTOR LATCH ACTUATOR WITH IMPROVED TORSIONAL RESISTANCE

(75) Inventors: Brian Keith Lloyd, Maumelle, AR (US); Barbara Byczkiewicz, Westford, MA (US)

(73) Assignee: Molex Incorporated, Lisle, IL (US)

( * ) Notice: Subject to any disclaimer, the term of this patent is extended or adjusted under 35 U.S.C. 154(b) by 120 days.

(21) Appl. No.: 13/981,347

(22) PCT Filed: Jan. 24, 2012

(86) PCT No.: PCT/US2012/022387

§ 371 (c)(1), (2), (4) Date: Sep. 11, 2013

(87) PCT Pub. No.: WO2012/103107

PCT Pub. Date: Aug. 2, 2012

(65) Prior Publication Data

US 2013/0344722 A1 Dec. 26, 2013

Related U.S. Application Data

(60) Provisional application No. 61/435,656, filed on Jan. 24, 2011.

(51) Int. Cl.

| | |
|---|---|
| ***H01R 13/62*** | (2006.01) |
| ***H01R 13/627*** | (2006.01) |
| *H01R 13/66* | (2006.01) |

(52) U.S. Cl.

CPC ..... *H01R 13/6275* (2013.01); *H01R 13/6658* (2013.01)

(58) Field of Classification Search

CPC ..... H01R 13/6275; H01R 13/6658
USPC ..... 439/159, 160, 352, 358
See application file for complete search history.

(56) References Cited

U.S. PATENT DOCUMENTS

| | | | | |
|---|---|---|---|---|
| 7,841,887 | B2 * | 11/2010 | Zhang et al. | 439/352 |
| 8,187,019 | B2 | 5/2012 | Reed et al. | |
| 8,740,637 | B2 * | 6/2014 | Wang et al. | 439/352 |
| 2006/0134985 | A1 | 6/2006 | Reed et al. | |

(Continued)

FOREIGN PATENT DOCUMENTS

| | | | |
|---|---|---|---|
| CN | 2917002 | Y | 6/2007 |
| CN | 200990447 | Y | 12/2007 |

(Continued)

OTHER PUBLICATIONS

International Search Report for PCT/US2012/022387.

*Primary Examiner* — Khiem Nguyen

(57) ABSTRACT

A cable connector assembly is disclosed for use in connecting electronic devices together. The connector has a housing and a mating blade in the form of a paddle card to which wires of a cable are terminated. The connector housing supports a latching mechanism with an actuator that when selectively pulled delatches the latching mechanism from its engagement with the housing of an electronic device. The actuator has an elongated pull tab portion that has a rounded edge for at least three of its four sides. This rounded edge eliminates the sharp corners associated with rectangular or square cross sections of conventional pull tabs, thereby removing stress riser points and giving the pull tab greater resistance against tearing when subjected to torsional loading.

13 Claims, 8 Drawing Sheets

(56) References Cited

U.S. PATENT DOCUMENTS

| | | | |
|---|---|---|---|
| 2009/0227133 | A1 | 9/2009 | Zhang et al. |
| 2009/0274468 | A1 | 11/2009 | Zhang et al. |

FOREIGN PATENT DOCUMENTS

| | | | |
|---|---|---|---|
| CN | 201699222 | U | 1/2011 |
| JP | H10302896 | A | 11/1998 |

* cited by examiner

CONNECTOR LATCH ACTUATOR WITH IMPROVED TORSIONAL RESISTANCE

REFERENCE TO RELATED APPLICATIONS

The Present Disclosure claims priority to prior-filed U.S. Provisional Patent Application No. 61/435,656, entitled "Connector Latch Actuator With Improved Torsional Resistance," filed on 24 Jan. 2011 with the United States Patent And Trademark Office. The content of the aforementioned Patent Application is fully incorporated in its entirety herein.

BACKGROUND OF THE PRESENT DISCLOSURE

The Present Disclosure relates generally to cable interconnection systems, and, more particularly, to improved cable connectors for use in high speed data transmission applications.

Conventional cable interconnection systems are often found in electronic devices, such as routers and servers, and are used to form connecting signal transmission lines between multiple devices. Such cable interconnection systems include cable connectors that are terminated to opposing ends of a multiple wire cable. The connectors most commonly utilize an edge card as a connector mating blade which is inserted into a corresponding receptacle of an opposing receptacle connector mounted to a circuit board within the electronic device. Many of these types of connectors utilize a tab-style actuator member, pulled on by the installer, to delatch the connector housing from the housing of the electronic device. Although these delatching members are intended to be pulled in a longitudinal direction along the axis of the cable associated therewith, many times the installer may turn them during pulling, inducing a torsional shear load upon the tabs. The industry has also recently adopted torsional tear tests of such delatching members to determine their reliability under torsional loading. It has been found that straight edge actuators are more susceptible to tearing under torsional load than expected.

The Present Disclosure is therefore directed to a cable connector, and particularly to a delatching tab, or actuator therefor, that resists tearing under torsional loading.

SUMMARY OF THE PRESENT DISCLOSURE

Accordingly, there is provided an improved cable assembly that has an improved delatching actuator, or tab that resists tearing when the delatching member is placed under torsion, such as by twisting.

In accordance with the Present Disclosure, a cable assembly is disclosed that utilizes a connector housing that partially encloses an end of a cable and a circuit board, or paddle card, to which the wires of the cable are terminated. The circuit board has a leading edge that protrudes from the connector housing so that it may be received within a card-receiving slot of an opposing, mating receptacle connector. The connector has a latching mechanism associated with it that may be manipulated to latch to or delatch from a housing on an electronic device to which the cable connector which connected. The latching mechanism has a generally U-shaped configuration that extends along the side of the connector housing and has two free ends that are selectively moved into and out of engagement with the electronic device housing.

The cable connector further includes an actuator, or delatching member, that extends longitudinally along the connector housing and is attached to the latching mechanism.

This delatching member is elongated and may be described as a pull tab, as an installer grips it and pulls on it in order to move the latching mechanism into a position where it does not engage an opposing housing. Prior actuators were made of plastic of similar material and were formed with a rectangular cross-section. It has been discovered that this cross-section and the hard edges or corners that give the cross-section its shape are locations where torsional stress concentrates and rises as the delatching member is twisted about its longitudinal axis.

In accordance with the Present Disclosure, the delatching member has a somewhat elliptical cross-section in that the side edges thereof do not have any right angle aspect, but rather present a rounded edge. The rounded edge may have a diameter equal to that of the thickness of the delatching member or it may be larger to produce a raised, bead-like edge that runs for most of the perimeter of the delatching member. This rounded edge removes the sharp corners previously used and removes the stress risers associated with such sharp sections.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
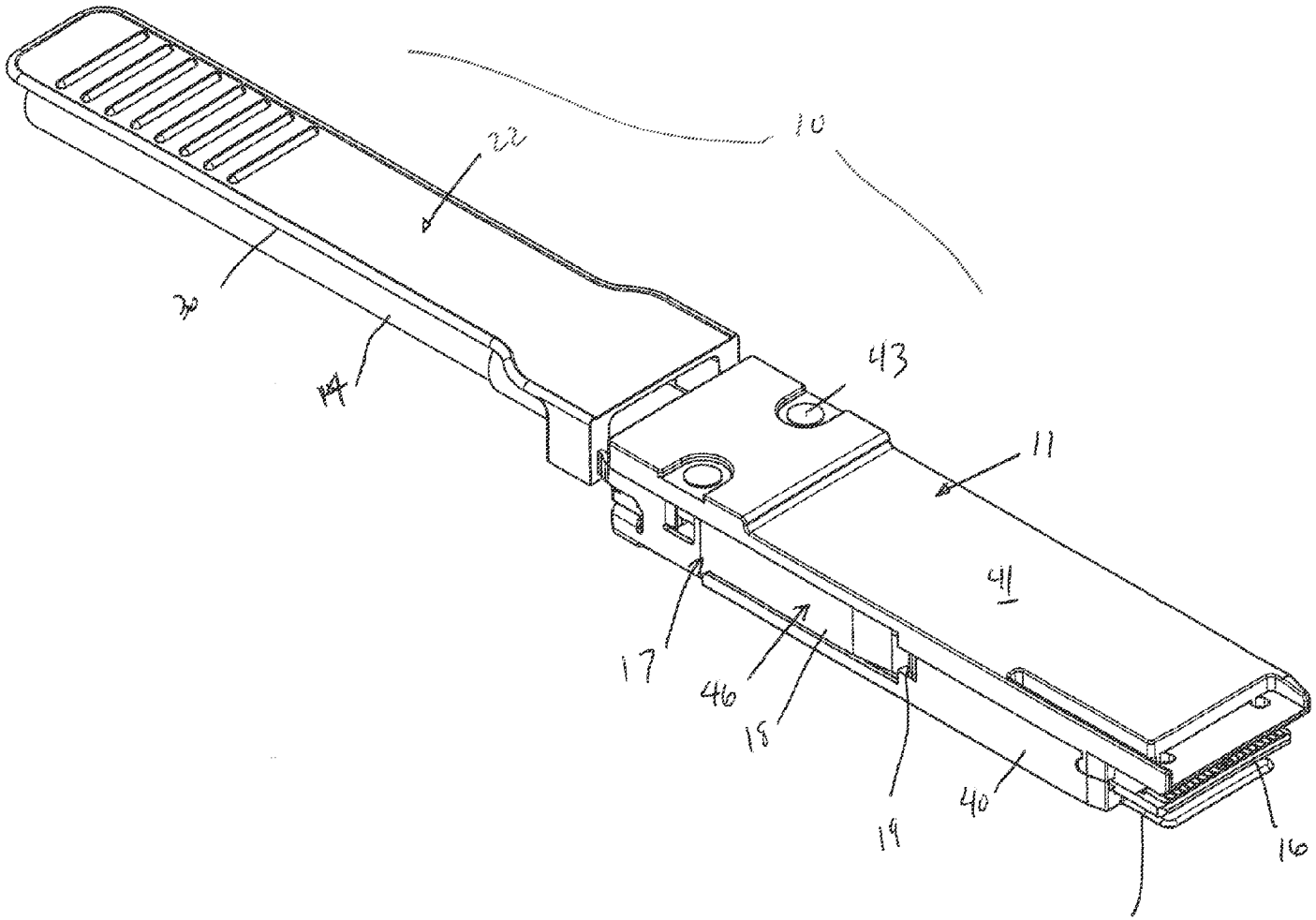
FIG. 1 is a perspective view of a cable connector assembly, constructed in accordance with the principles of the Present Disclosure.
Figure 2:
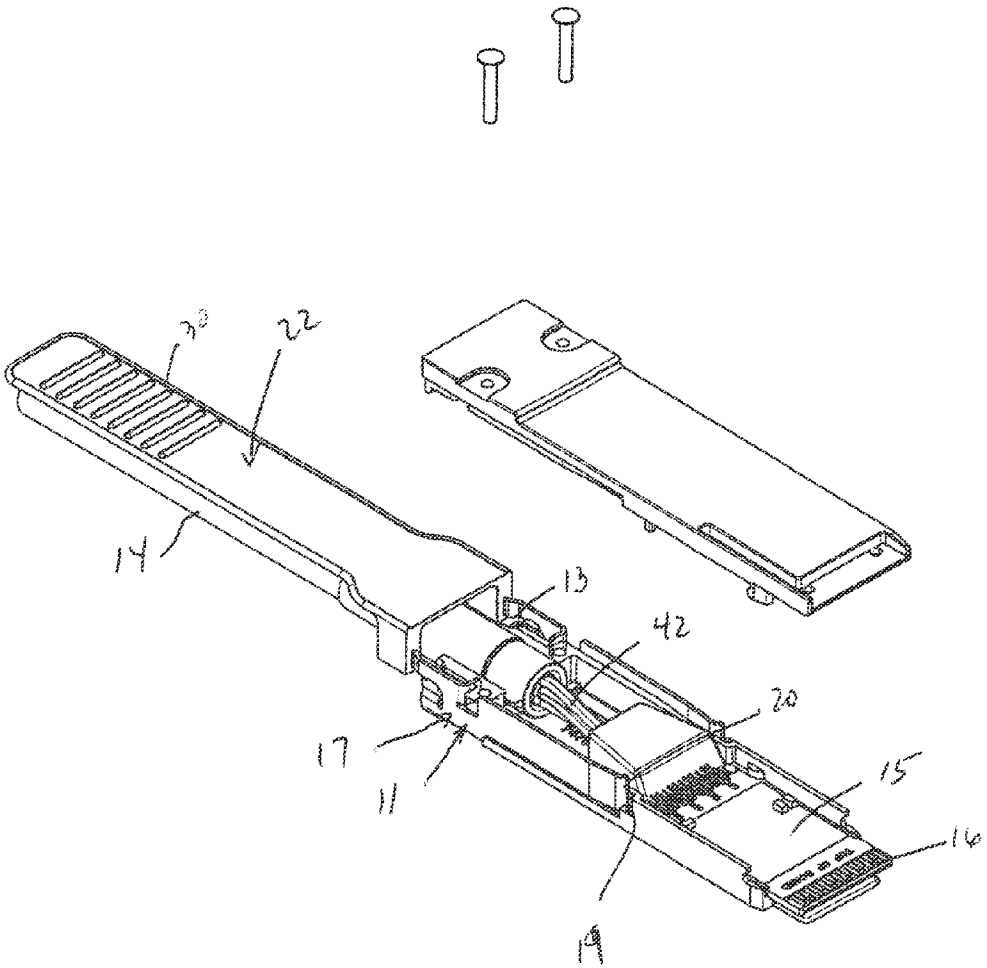
FIG. 2 is the same perspective view as FIG. 1, but with the top cover portion of the connector housing removed for clarity.
Figure 3:
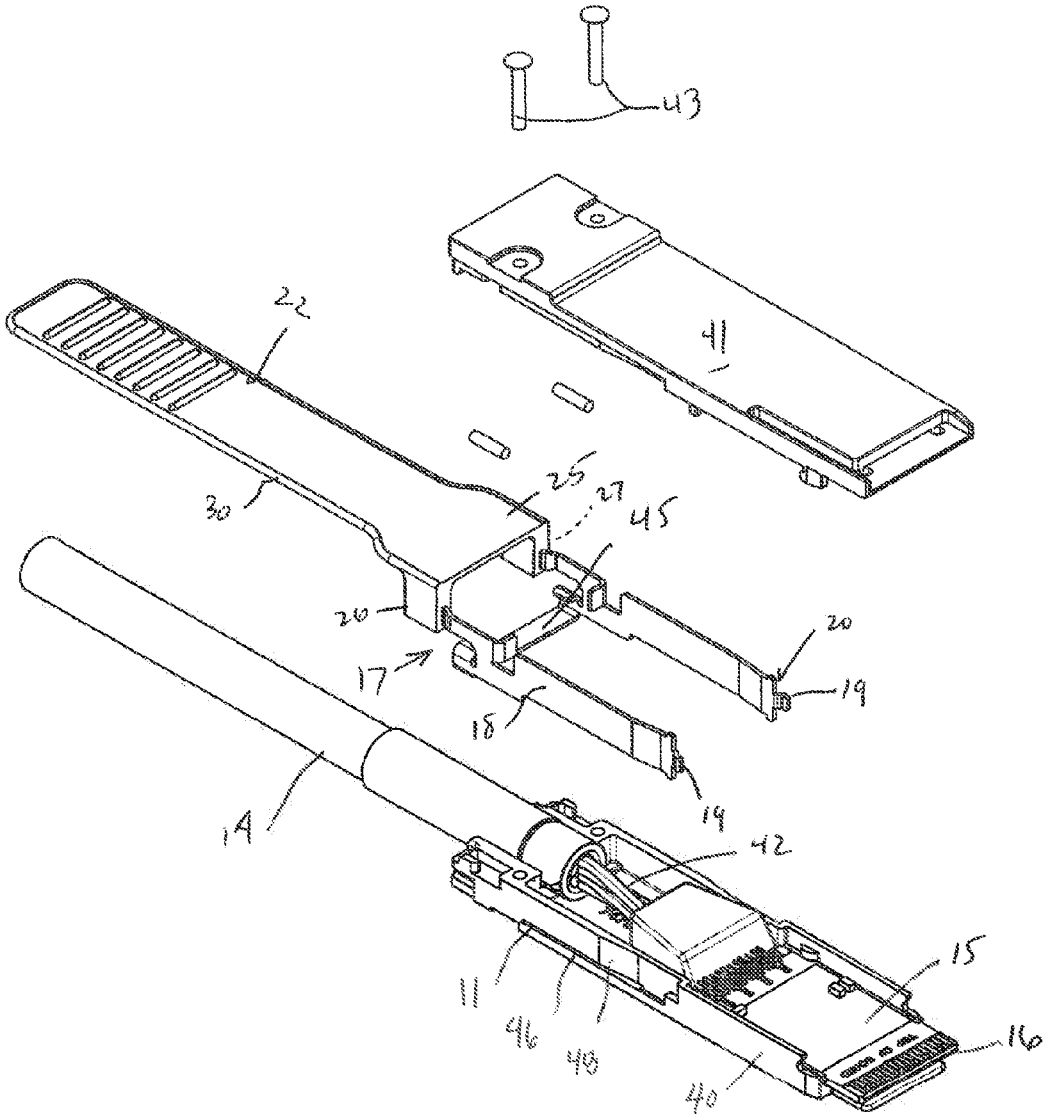
FIG. 3 is the same perspective view as FIG. 2, but with the latching mechanism removed for clarity.
Figure 4:
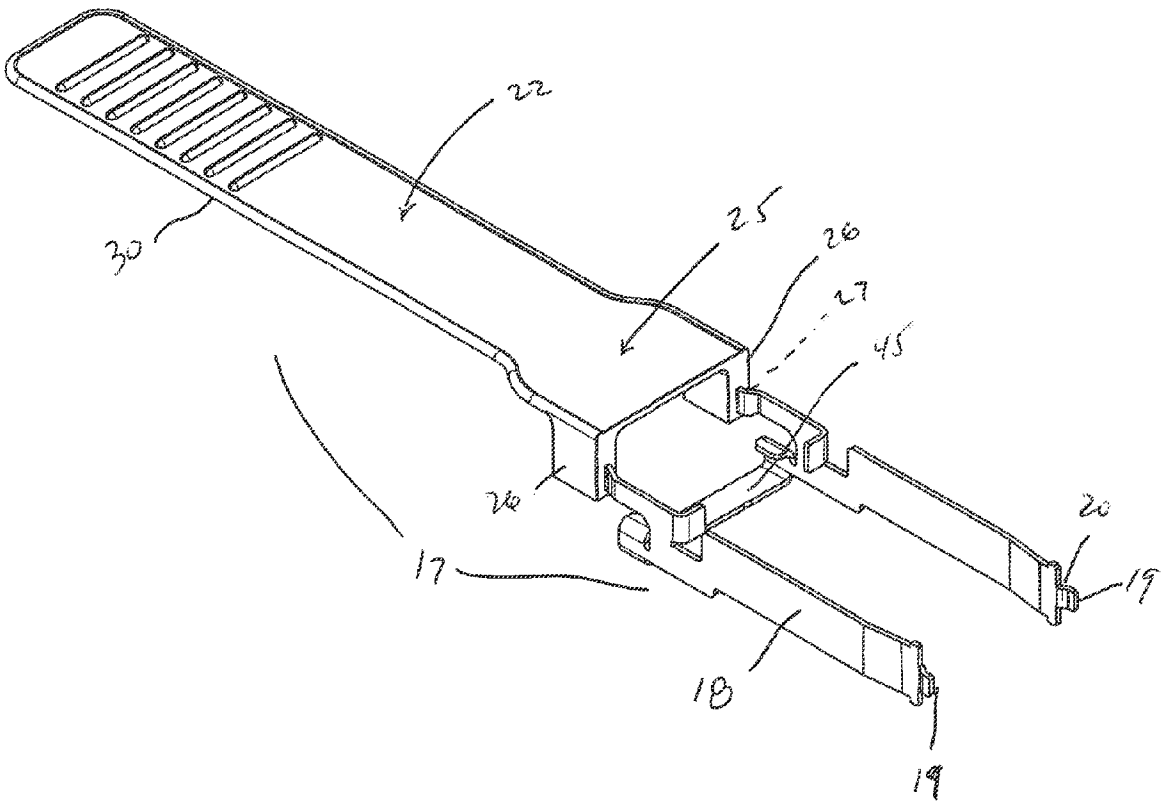
FIG. 4 is a perspective view of the latching mechanism of the cable connector assembly of FIG. 1.
Figure 5:
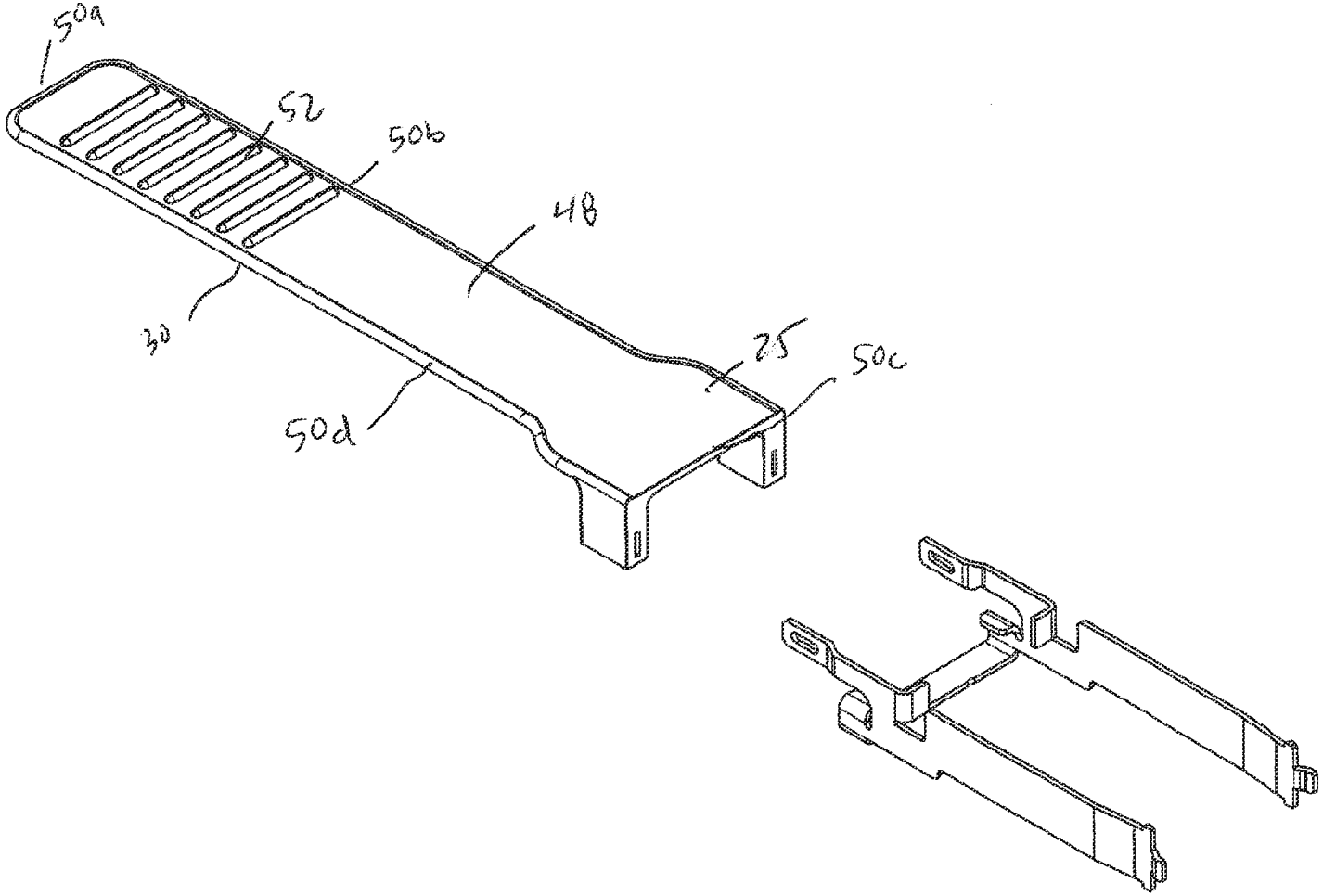
FIG. 5 is the same perspective view as FIG. 4, but with the delatching member removed for clarity.
Figure 6:
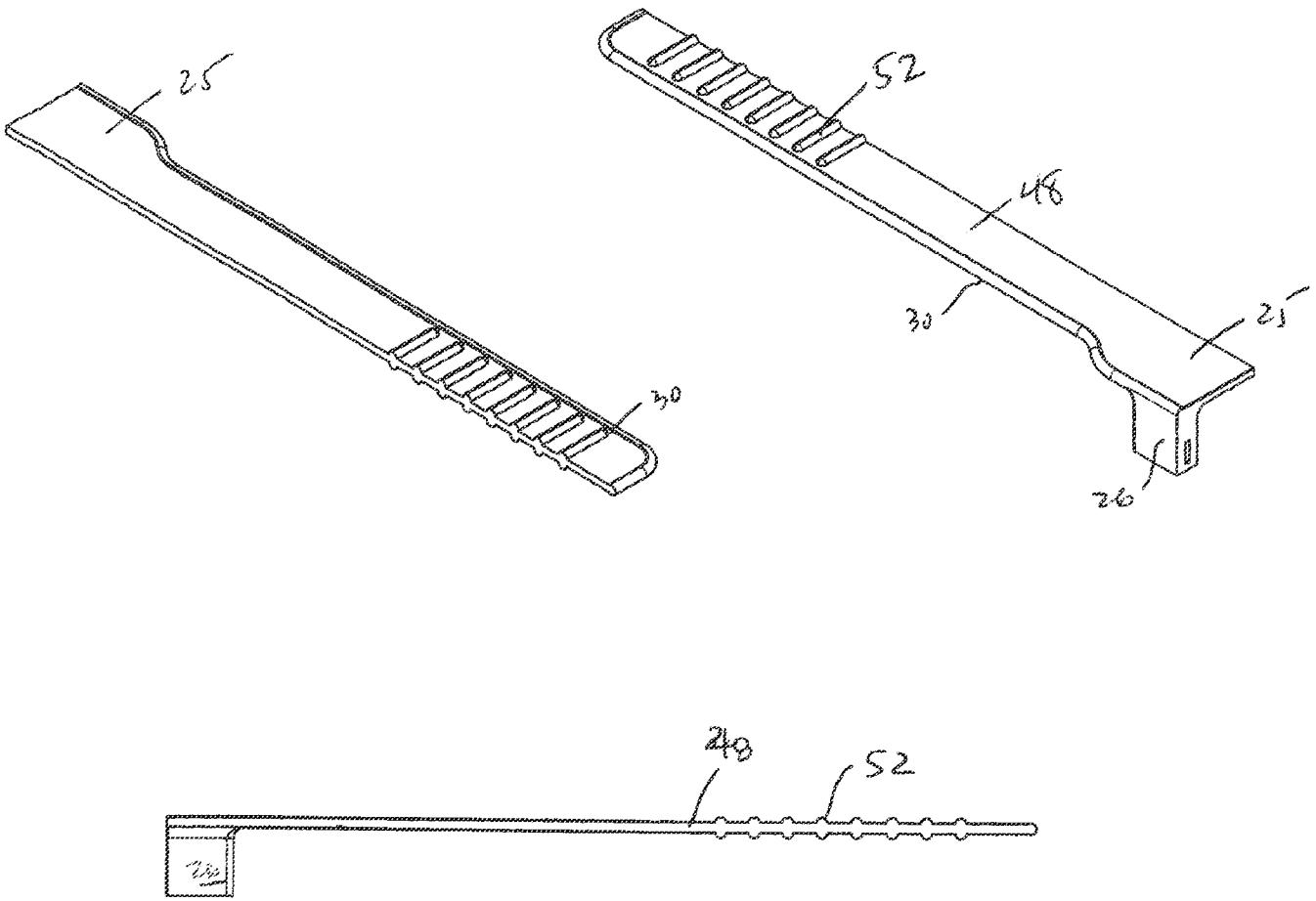
FIG. 6 is a longitudinal sectional view of the latching mechanism of FIG. 4, but with the delatching member removed for clarity.

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

FIGS. 1-5 illustrate a cable assembly 10 having a protective connector housing 11 with a hollow termination end 13 that receives an end of a multiple-wire cable 14. The connector housing 11 has a mating end 12 that includes a mating blade, shown as a circuit board, or paddle card 15 in an orientation suitable for mating with an opposing, mating receptacle connector (not shown) having a slot which receives the leading edge 16 of the circuit board 15. The connector housing is hollow and as illustrated, it may have a base portion 40 and a cover portion 41 that cooperatively mates with the base portion 40 to define a hollow enclosure that houses a portion of the circuit board 15 and the wires 42 of the cable 14. The cover portion 41 may be attached to the connector housing base portion 40 by way of rivets 43 illustrated, screws or any suitable means of attachment.

In order to provide a means for ensuring engagement with the opposing connector after mating with it, the connector assembly 10 is preferably provided with an elongated latch mechanism 17 that includes a generally U-shaped latching member 18 with engagement hooks 19 or the like, disposed at the free ends 20 of the latching member 18. These hooks 19 typically engage shoulder or openings (not shown) formed in the housing of the electronic devices in which cable assemblies of the disclosure are inserted. The latch member 18 is actuated by the manipulation of an elongated actuator, or delatching member, 22, which is shown as a pull tab 23. The latch member 18 illustrated has a pair of latching members spaced apart from each other by way of an interconnecting bridge, or connecting portion 45. The latching members 18 are received within slots 46 formed in the sidewalls 47 of the connector housing 11 and the free ends 20 of the latching members 18 are formed with an inward bend, or bias, so that they will engage, during movement, angled cam surfaces 48 formed in the slots 46 of the connector housing 11. Although the latching mechanism illustrated is one having two distinct latching members, it is anticipated that the principles of the Present Disclosure may be applied to a connector assembly utilizing only a single latching member and an associated pull tab.

Figure 7A:
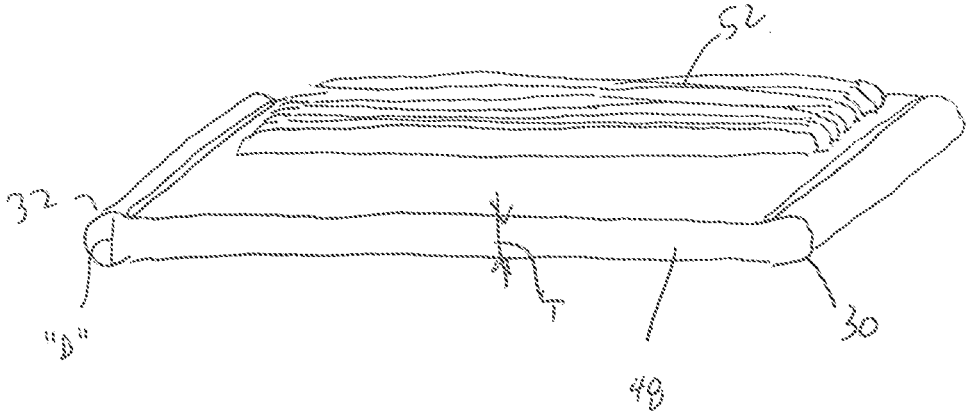
FIG. 7A is a sectional view of a cable connector with the cable circuit board assembly of FIG. 6.

The latching members 18 have tail end portions 27 and in the Figures, it can be seen that the pull tab 23 has a body portion 25 with two legs 26 that depend downwardly therefrom in spaced apart fashion. These legs 26 have slots that receive the tail ends 27 of the latching member 18. Alternatively, the pull tab 23 may be molded over the ends 27. The pull tab has a narrower gripping portion 48 that extends rearwardly from the body portion 25 and generally is longitudinally aligned with and spaced above from the cable 14. Importantly, substantially the entire perimeter of the pull tab 23 is formed with a rounded edge 30. This rounded edge 30 may, as illustrated in FIG. 7A, take the form of a rounded bead 32 that is slightly larger than the thickness of the pull tab 23. In other words, the diameter D of the rounded edge is greater than the thickness T of the pull tab. In this manner, the rounded bead 32 has a profile that extends outwardly from the top and bottom surfaces of the pull tab gripping portion 48 so that the bead 32 can be easily located by touch. To facilitate the grasping of the pull tab gripping portion 48, transverse ridges 52 may be formed on the top and bottom surfaces thereof, with the ends thereof terminating before and spaced from the rounded edges 30.

Figure 7B:
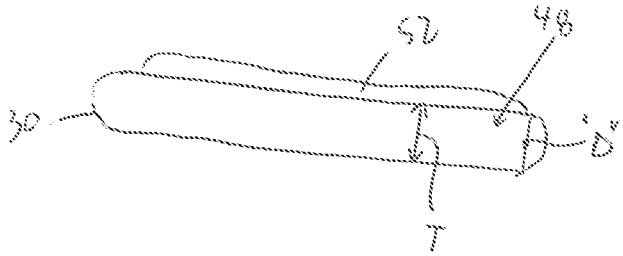
FIG. 7B is a sectional view of an alternate cross-section of a delatching member.

Another embodiment of a pull tab incorporating the principles of the Present Disclosure is illustrated in FIG. 7B, and it can be seen that the diameter D is equal to the thickness T and as such, no bead-like edge is formed that extends above the level of the pull tab 23. The pull tab shown in the Figures has a generally rectangular shape and may be considered as having four distinct sides 50*a-d* (with the longitudinal sides 50*b* and 50*d* that extend between the end sides 50*a* and 50*c* being considered as a single side each), and the rounded edge 30 extends along the perimeter of three of the four sides, 50*a*, 50*b* and 50*d*. Alternatively, the rounded edge 30 may extend along an extent of the perimeter that is greater in distance than the 75% of the total sides parameter. Thus it is preferred that the rounded edge extend at least equal to about 75% of the total perimeter distance.

Figure 8:
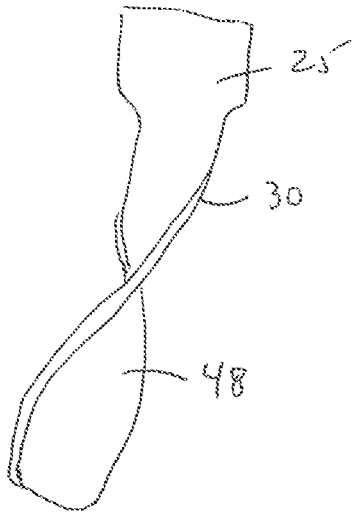
FIG. 8 is a diagram illustrating a torsional force applied to the pull tab which causes tearing of a conventional cross-section thereof.

FIG. 8 is a diagram that explains the torsional loading. As shown therein, the gripping portion 48 is twisted more than 90 degrees from its in-plane position. At the location designated as "X", approximately midway between the two ends, the prior sharp corners acted as stress risers, areas where the torsional shear stress rose to an undesirable level, the end result was a likelihood for the pull tabs to begin tearing in this area. The use of a rounded edge, or bead, eliminates the sharp corners and right-angled edges and adds additional material extending out from where the flat side of the pull tab sides would be. This material also assists in resisting the torsional shear stress and serves to lower any stress concentration that may occur to a non-problematic level.

While a preferred embodiment of the Present Disclosure is shown and described, it is envisioned that those skilled in the art may devise various modifications without departing from the spirit and scope of the foregoing Description and the appended Claims.

What is claimed is:

1. An improved cable connector assembly, comprising:

a connector housing, the connector housing including a hollow interior and a rear opening for receiving a cable therein;

a circuit board, the circuit board including opposing leading and trailing edges, the leading edge at least partially extending out of the connector housing along a mating face thereof, the trailing edge being disposed within the connector housing to provide a termination location for wires of the cable; and a latching mechanism, the latching mechanism being adapted for latching the connector housing to an electronic device and including at least one latching member, extending longitudinally along the connector housing, and an actuator member, for moving one of the latching members out of engagement with the electronic device, the actuator member including a pull tab extending longitudinally along the cable, and further including a defined perimeter, a rounded edge extending along a substantial extent of the perimeter, the rounded edge providing the pull tab with increased resistance to tearing when subjected to torsional forces.

2. The cable connector assembly of claim 1, wherein the pull tab has a thickness T, and the rounded edge has a diameter D that is equal to or greater than the pull tab thickness, T.

3. The cable connector assembly of claim 2, wherein the pull tab diameter D is greater than the pull tab thickness T.

4. The cable connector assembly of claim 1, wherein the rounded edge has a bead-like configuration.

5. The cable connector assembly of claim 1, wherein the pull tab includes a body portion, from which the latching member extends, and a gripping portion, that extends rearwardly of the body portion, the gripping portion being narrower than the body portion.

6. The cable connector assembly of claim 1, wherein the pull tab includes four distinct sides, and the rounded edge extends around a perimeter of at least three of the four sides.

7. The cable connector assembly of claim 4, wherein the rounded edge includes an exterior surface that extends outwardly past opposing top and bottom surfaces of the pull tab.

8. The cable connector assembly of claim 1, wherein the pull tab includes a plurality of transverse ridges disposed on at least one of the top and bottoms surfaces thereof, the ridges being spaced apart from the rounded edges.

9. A pull tab for use with a latching mechanism, the pull tab comprising:

an elongated member, the elongated member including a body portion and a gripping portion, the body portion engaging ends of a latching mechanism and the gripping portion extending longitudinally from said body portion;

wherein the gripping portion includes a rounded edge extending substantially around a perimeter thereof, the rounded edge giving the gripping portion increased resistance to shear stress induced by twisting thereof.

10. The pull tab as set forth in claim 9, wherein the gripping portion has a thickness T and the rounded edge has a diameter D that is equal to or greater than the thickness T.

11. The pull tab as set forth in claim 10, wherein the diameter D is greater than the thickness T so as to form a bead along the rounded edge.

12. The pull tab as set forth in claim 11, wherein the bead rises above opposing top and bottom surfaces of the gripping portion.

13. The pull tab as set forth in claim 9, wherein the gripping portion is narrower than the body portion.

* * * * *